United States Patent [19]

Oura

[11] Patent Number: 4,586,641

[45] Date of Patent: May 6, 1986

[54] APPARATUS FOR ATTACHING PAIRS OF FASTENER ELEMENTS ONTO GARMENT FABRICS

[75] Inventor: Hiroshi Oura, Kurobe, Japan

[73] Assignee: Nippon Notion Kogyo Co., Ltd., Tokyo, Japan

[21] Appl. No.: 649,320

[22] Filed: Sep. 11, 1984

[30] Foreign Application Priority Data

Sep. 19, 1983 [JP] Japan ..... 58-144668[U]
Sep. 19, 1983 [JP] Japan ..... 58-144669[U]

[51] Int. Cl.[4] ..... A41H 37/04

[52] U.S. Cl. ..... 227/15; 227/30; 227/31; 227/119; 227/140; 227/149

[58] Field of Search ..... 227/15, 30, 31, 152, 227/149, 43, 114, 119, 140; 269/13, 14, 234

[56] References Cited

U.S. PATENT DOCUMENTS 1,083,420 1/1914 White ..... 227/43
1,183,822 5/1916 Stanley et al. ..... 227/43
2,373,436 4/1945 Freciokas ..... 227/149
4,436,238 3/1984 Seki ..... 227/152 X

*Primary Examiner*—Robert L. Spruill
*Assistant Examiner*—Taylor J. Ross
*Attorney, Agent, or Firm*—Hill, Van Santen, Steadman & Simpson

[57] ABSTRACT

An apparatus for attaching a pair of fastener elements onto a garment fabric comprising a cooperating pair of an upper die unit and a lower die unit, a stationary anvil mounted in the lower unit, a plunger reciprocably mounted in the upper unit, a punch movable relative to the plunger along a path of movement toward and away from the lower unit, and a pair of clamping jaws operatively associated with the upper die unit for releasably clamping one of the fastener elements. A means is provided for holding one fastener element in proper position against displacement for aligned engagement with the other mating element. The apparatus further includes means for manually releasing the fastener element which has been trapped in the event of failure of the apparatus.

4 Claims, 11 Drawing Figures

APPARATUS FOR ATTACHING PAIRS OF FASTENER ELEMENTS ONTO GARMENT FABRICS

BACKGROUND OF THE INVENTION

1. Field of the Invention

This invention relates generally to an apparatus for attaching pairs of fastener elements such as snap fasteners, buttons, rivets or the like onto a garment fabric, and more particularly to improvements in and relating to fastener clamping means forming part of such attaching apparatus.

2. Prior Art

The term fastener elements as used herein generally designates a pair of mating elements that are attached onto a garmet or sheet-like material from opposite sides thereof. Setting of these elements properly on the garment requires that the two elements to be held accurately in alignment with each other with their respective postures unchanged until they contact and grip the garment.

There have been proposed a number of fastener attaching machines. A common problem associated with those conventional machines is however that such fastener elements which are relatively small in size and light in weight tend to be displaced during attachment and become misplaced on the garment fabric. Another problem of the prior art is that it is difficult or otherwise tedious to release the fastener elements for removal from the clamping jaws holding the elements therebetween when testing the flow of a supply of fastener elements or when shutting down for machine failures.

SUMMARY OF THE INVENTION

A first pair of clamping jaws associated with the die unit hold one of the elements resiliently therebetween. A pusher means is provided for spreading the first pair of jaws apart to release the element which has been trapped. A second pair of clamping jaws associated with the lower die unit hold the other mating element therebetween against the anvil until they release the element upon coupling engagement with said one element across the garment.

It is an object of the invention to provide a fastener attaching apparatus incorporating means for ensuring proper positioning of a fastener element against displacement until it is applied to a garment.

Another object of the invention is to provide a fastener attaching apparatus incorporating means for facilitating removal of the fastener element from the apparatus when desired for testing the flow of a supply of elements, or for inspection of the parts during shutdown of the apparatus.

The above and other objects, advantages and features of the invention will become apparent from the following description of a certain preferred embodiment taken in conjunction with the accompanying drawings, in which like numerals refer to like or corresponding parts.

DETAILED DESCRIPTION

Figure 1:
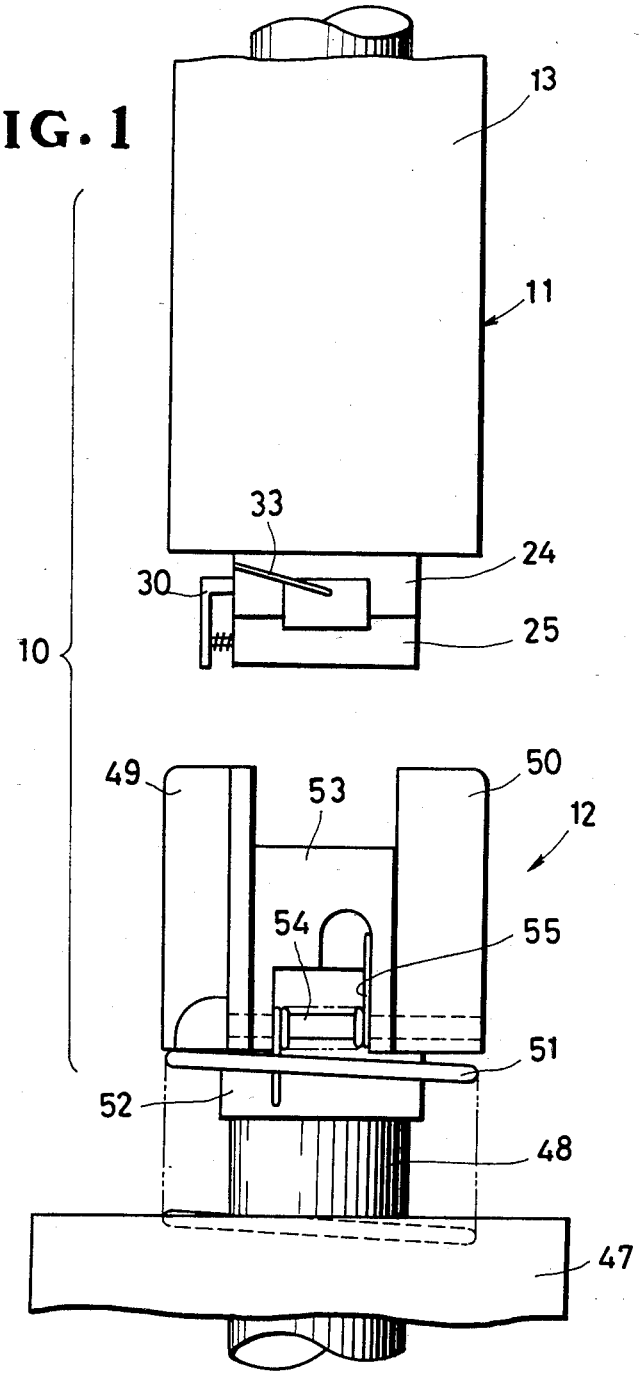
FIG. 1 is a front elevation of an apparatus constructed in accordance with the invention.
Figure 9A:
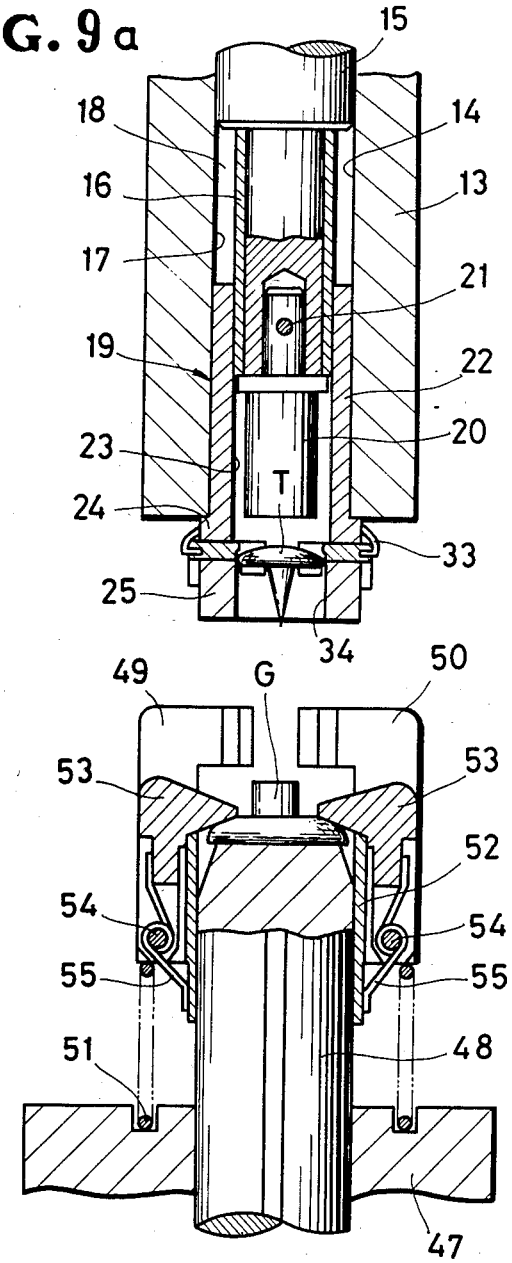
FIGS. 9*a*, 9*b* and 9*c* inclusive are elevational, partially sectional views utilized to explain the operation of the apparatus according to the invention.

Referring now to the drawings and FIG. 1 in particular, there is shown a fastener attaching apparatus generally designated at 10 which comprises a cooperative pair of upper and lower die units 11 and 12 mounted in a housing (not shown) in vertically opposite relation to each other. As shown in FIG. 9*a*, the upper die unit 11 includes a support block 13 having a cylindrical bore 14 and a ram 15 reciprocable therein. The ram 15 has a reduced diameter portion 16 defining with the inner peripheral wall 17 of the support block 13 an annular clearance 18 for receiving a plunger 19 later described. A punch 20 is secured by a pin 21 to and extends coaxially from the reduced portion 16 of the ram 15.

The plunger 19 has a cylindrical member 22 coaxially mounted in the block 13 between the inner periphery 17 and the reduced portion 16 and having a bore 23 for accommodating therein the punch 20 as better shown in FIG. 9.

The plunger 19 also includes a pair of upper and lower square blocks or holders 24 and 25 for holding therein one of mating fastener elements, e.g. a tack T as in the illustrated embodiment, the upper block 24 being integral with the cylindrical member 22.

Figure 2:
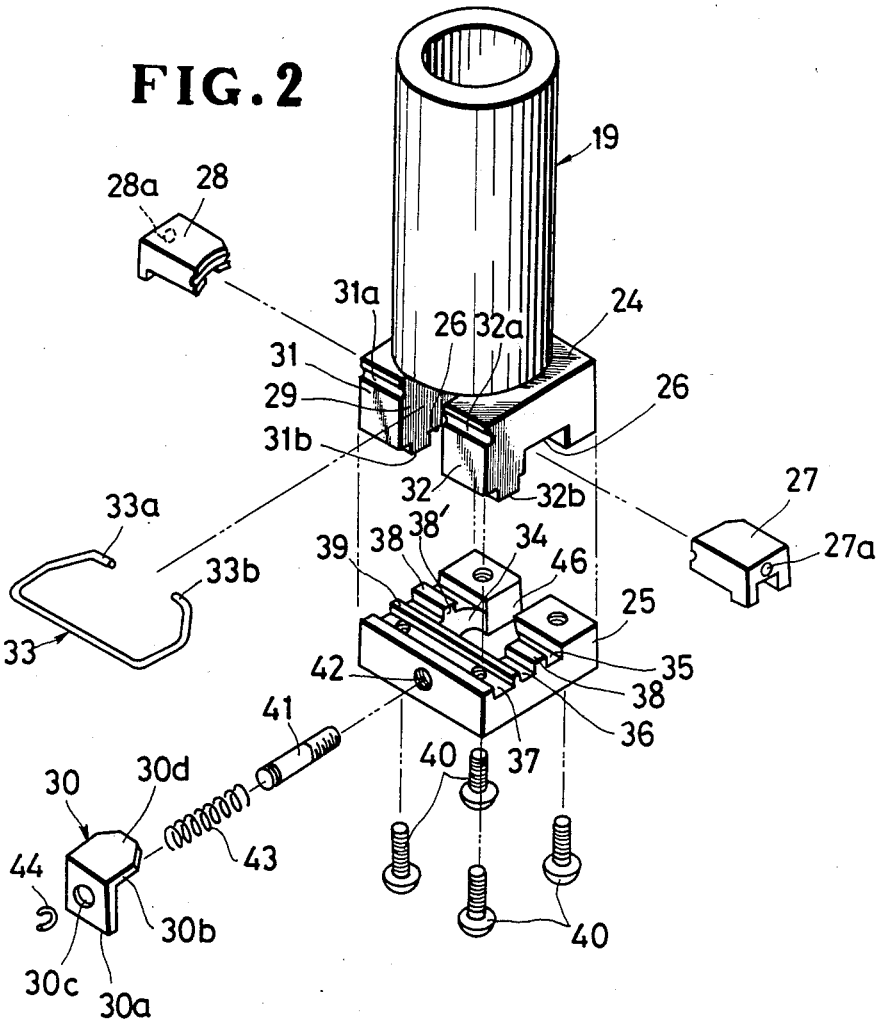
FIG. 2 is an exploded perspective view of an upper unit of the apparatus.

FIG. 2 shows the various parts of the plunger 19; the upper block 24 has a first recess 26 formed throughout in its bottom and extending diametrically across the cylinder bore 14 (FIG. 9*a*) for receiving a pair of clamping jaws 27, 28, later described, from opposite sides of the block 24. There is formed a second recess 29 in the upper block 24, which recess 29 extends at a right angle to and in communication with the first recess 26 for receiving a pusher 30 later described. The second recess 29 provides bifurcated end portions 31, 32 having a pair of aligned transverse grooves 31*a*, 32*a*, for receiving a wire spring 33.

The pair of clamping jaws 27, 28 is inserted in the first recess 26 of the upper block 24 from opposite sides thereof and normally urged inwardly toward each other by the wire spring 33 having both of its ends 33*a*, 33*b* U-turned to be anchored in blind holes 27*a*, 28*a* of the respective clamping jaws 27, 28. Conveniently, the wire spring 33 may be detached to release and remove the clamping jaws 27, 28 so as to permit servicing of the interior of the upper die unit 11.

The lower block 25 has a central bore 34 communicating coaxially in alignment with the bore 23 of the cylindrical member 22 for accommodating the tack T until the latter is brought by the punch 20 into engagement with its mating grommet G (FIG. 9).

The lower block 25 has alternate grooves 35, 36, 37 and ridges 38, 39, of which grooves 35, 36 and ridge 38 are each bifurcated by but aligned across the bore 34.

The outermost groove 37 in the lower block 25 is adapted to engage with projections 31*b* and 32*b* extending downwardly from the upper block 24 for positioning one block relative to the other when coupling the two blocks 24, 25 together by set screws 40 at the positions schematically shown in FIG. 2.

The pusher 30, which is generally inverted-L shaped, consists of a vertical plate member 30*a* and a horizontal plate member 30*b*. The vertical member 30*a* has an aperture 30*c* for receiving one end of a support pin 41, the other end of which is received in a blind hole 42 formed in an end wall of the lower block 25 adjacent to the outermost groove 37. The support pin 41 is inserted through a compression coil spring 43 and retained at the other end in the aperture 30*c* by means of an C-spring 44. The horizontal member 30*b* has a tapered end 30*d* engageable with the oppositely disposed clamping jaws 27, 28 for purposes to be hereafter described.

Figure 3:
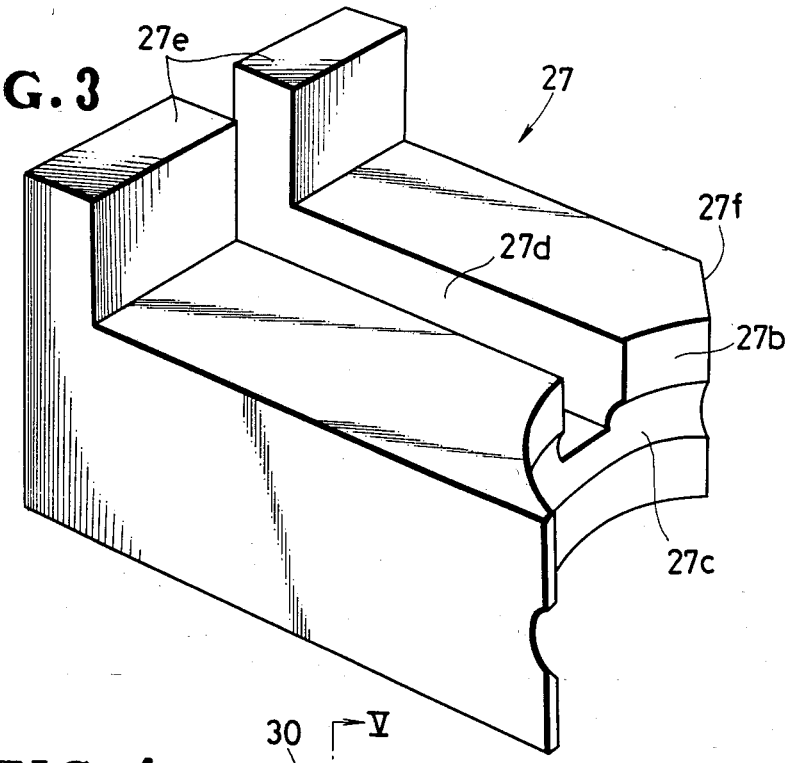
FIG. 3 is a perspective view on enlarged scale of a clamping jaw forming part of the apparatus.

FIG. 3 shows the lower side of the clamping jaw 27, (28), inverted. Each clamping jaw has an arcuate inner end 27*b* with a peripheral guide groove 27*c* for guidedly receiving the peripheral flange portion of the tack T, and a longitudinal recess 27*d* for sliding engagement with the ridge 38 of the lower block 25. On opposite sides of the longitudinal recess 27*d* and at an end opposite to the arcuate end 27*b* are identical downward projections 27*e* which serve to limit movement of the clamping jaw 27 toward the bore 34 of the lower block 25.

Figure 4:
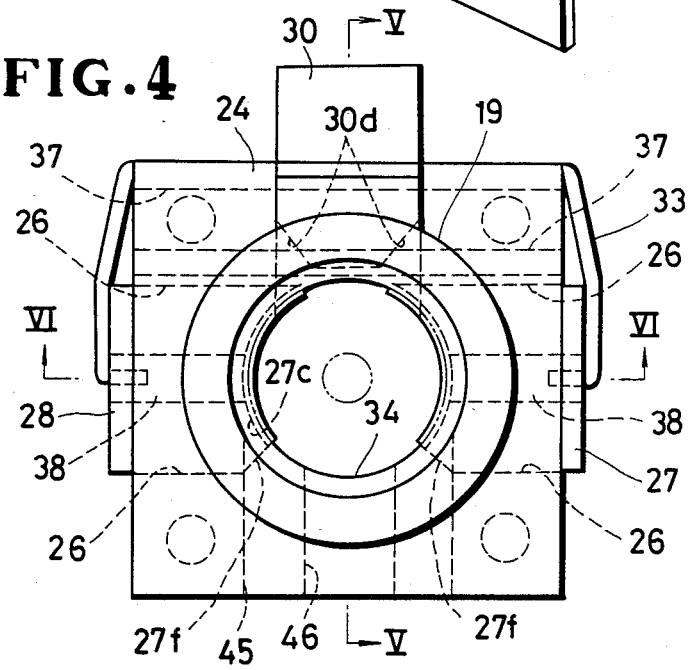
FIG. 4 is a plan view of the upper unit of FIG. 2.
Figure 5:
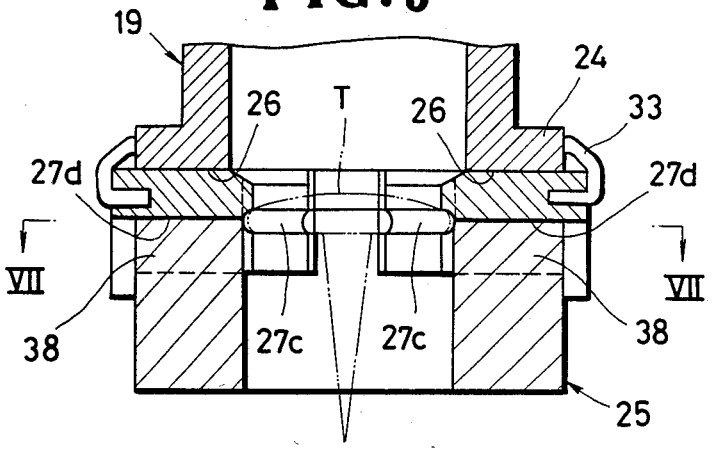
FIG. 5 is a cross-sectional view taken along the lines V—V of FIG. 4.
Figure 6:
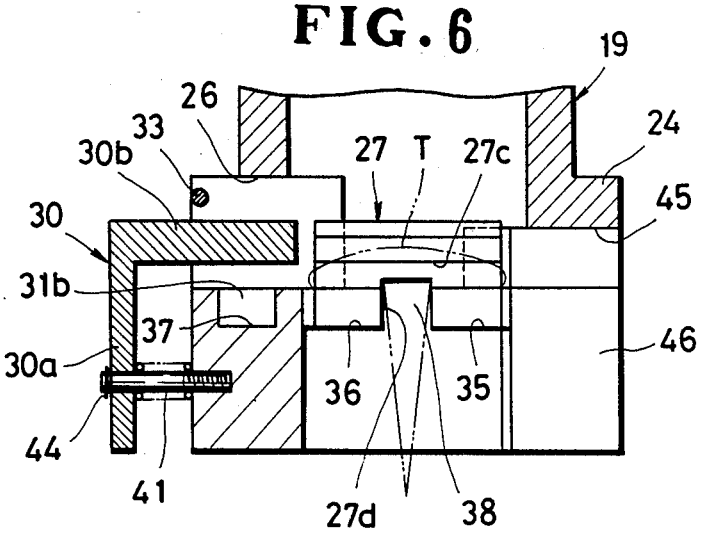
FIG. 6 is a cross-sectional view taken along the lines VI—VI of FIG. 4.
Figure 7:
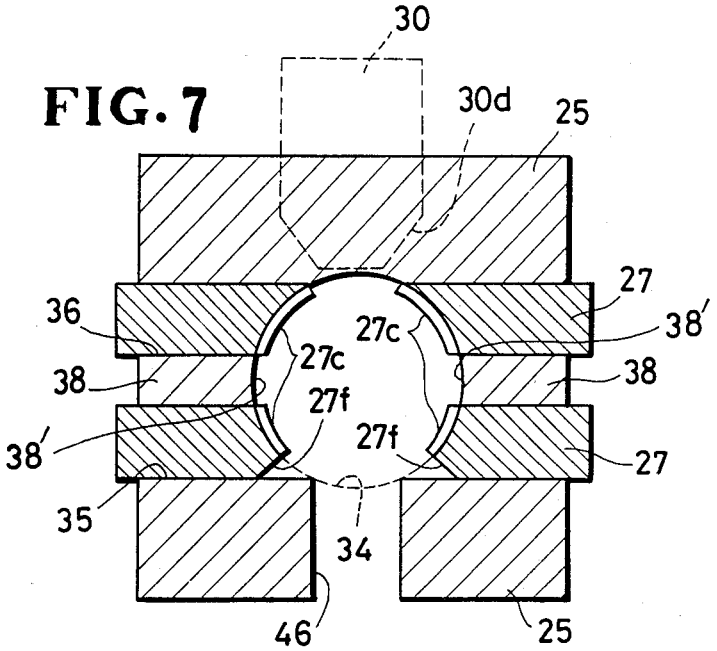
FIG. 7 is a cross-sectional view taken along the lines VII—VII of FIG. 5.
Figure 8:
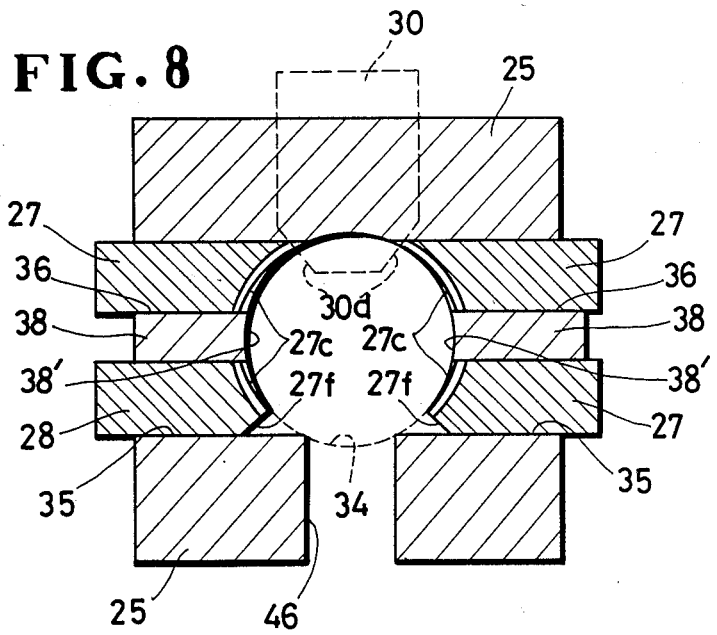
FIG. 8 is a view similar to FIG. 7 but illustrating the behavior of movable parts.

For mounting the tack T in place in the upper die unit 11, there are provided a through opening 45 (FIGS. 4 and 6) in the upper block 24 opposite to the second recess 29, which opening 45 guidedly receives the flange part of the tack T therethrough into the path of the punch 20 along the bore 23 of the plunger 19, and an opening 46 in the lower block 25 communicating with the opening 45 and merging with the bore 34 for freely receiving the pin part of the tack T. To permit entry of the tack T, the clamping jaw 27, (28) has a tapered corner 27*f*.

Figure 9B:
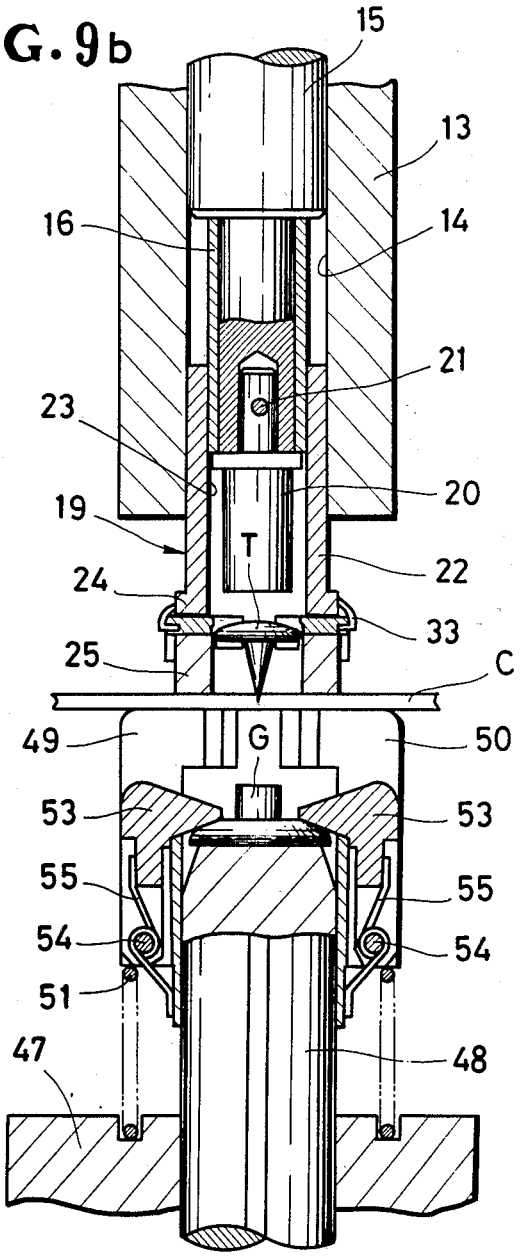
Figure 9C:
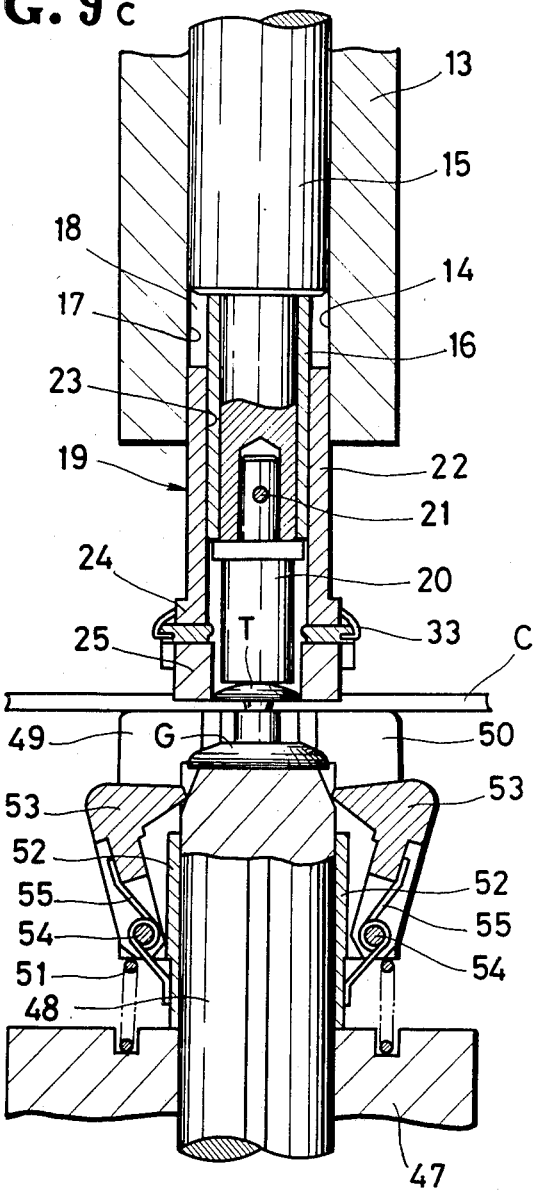

FIGS. 9*a*–9*c*, show a lower die unit 12 which may be of any conventional form and construction for cooperating with the upper die unit 11 in clamping and attaching the fastener elements onto a garment fabric C. The lower die unit 12 includes a base 47 and a cylinder-type stationary anvil 48 fixedly mounted therein. A pair of support blocks 49, 50 movable relative to the anvil 48 are movably supported on a compression coil spring 51 secured to the base 47 and disposed in surrounding relation to the anvil 48. A sleeve 52 is slidably mounted on the anvil 48 and supports the support blocks 49, 50.

A pair of clamping jaws 53 is pivotally connected by pins 54 via torsion springs 55 to the sleeve 52. The clamping jaws 53 are normally biased by the spring 55 toward each other to hold the grommet part G of the fastener against the top surface of the anvil 48 as shown in FIG. 9*a*. As the lower die unit 12 does not form any novel part of the invention, no further description of the details of this unit construction is requred. FIG. 9*b* illustrates the first sequence of operation of the apparatus 10 in which the plunger 19 of the upper die unit 11 descends with the lower block 25 held in abutting engagement with the top surfaces of the support blocks 49, 50 of the lower die unit across the garment fabric C. FIG. 9*c* illustrates the second sequence of operation in which the punch 20 strikes and urges the tack T through the fabric C into clamping engagement with the grommet G, when the plunger 19 is also allowed to descend by a distance required to move the clamping jaws 53 pivotally apart thereby releasing the grommet G.

As to the construction of the upper die unit 11 as shown in FIGS. 2–8, it is to be noted that when the tack T is mounted in position with its flange seated snugly in the peripheral guide grooves 27*c* of the clamping jaws 27, 28, the ridge 38 of the lower block 25 has an inner end wall 38' normally extending into the region of the guide groove 27*c*. This ensures that as the clamping jaws 27, 28 move apart in response to the force applied by the punch 20, the flange of the tack T is peripherally captured by the ridge 38, more precisely, by its end wall 38' so as to eliminate the possibility of the tack T becoming displaced as a result of departure of the clamping jaws 27, 28. The tack T is thus precisely targetted toward the mating grommet G.

While on reference to the same views of the drawings, there is another feature of the invention which resides in the provision of the pusher 30 which is adapted to engage and spread the opposed clamping jaws 27, 28 apart to release the tack T that has been trapped in the upper die unit 11 in the event of failure of the apparatus.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for attaching a pair of fastener elements onto a garment fabric which comprises:

(a) an upper die unit including a vertically reciprocative cylindrical plunger;

(b) a lower die unit including a stationary anvil;

(c) a punch mounted in and movable relative to said plunger along a vertical path of movement toward and away from said anvil for pressing one of the fastener elements in said upper die unit against the other fastener element in said lower die unit;

(d) an upper block integral with said plunger and provided with a first recess extending across said vertical path of said punch and a second recess extending at a right angle to and in communication with said first recess;

(e) a pair of clamping jaws slidably received in said first recess and normally resiliently urged toward each other for releasably clamping therebetween one of the elements, each of said clamping jaws including an inner end with a peripheral guide groove formed therein for guidedly receiving said one fastener element and a longitudinal recess opening at its one end to said peripheral guide groove;

(f) a manually operative pusher resiliently received in said second recess and adapted to engage and spread said pair of clamping jaws apart for releasing said one fastener element; and (g) a lower block secured to said upper block and including a bore coaxially aligned with said cylindrical plunger and a pair of grooves extending across said bore and defining therebetween a ridge for slidably engaging with said longitudinal recess of each of said clamping jaws, said inner end of each said clamping jaws normally projecting into said bore, said ridge being interrupted by said bore and having opposed inner end walls each normally extending into the region of said guide groove of a corresponding one of said clamping jaws.

2. An apparatus according to claim 1, said lower block including a further groove extending parallel to said pairs of grooves, and said upper block having downwardly extending projections for engagement with said further groove in said lower block.

3. An apparatus according to claim 1, said pusher being generally inverted-L shaped, having a vertical plate member and a horizontal plate member, said horizontal member having a tapered end engageable with said clamping jaws to spread the latter apart.

4. An apparatus according to claim 1, said clamping jaws being held in position externally by a wire spring which is manually removable.

* * * * *